US011565539B2

(12) United States Patent
Ruiz Martinez et al.

(10) Patent No.: US 11,565,539 B2
(45) Date of Patent: Jan. 31, 2023

(54) FORWARD AND BACKWARD ROTATION OF PRINTER CUTTERS

(71) Applicant: HEWLETT-PACKARD DEVELOPMENT COMPANY, L.P., Spring, TX (US)

(72) Inventors: Felix Ruiz Martinez, Sant Cugat del Valles (ES); Martin Urrutia Nebreda, Sant Cugat del Valles (ES); Daniel Hernandez, Sant Cugat del Valles (ES); Joseba Ormaechea Saracibar, Sant Cugat del Valles (ES)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/603,569

(22) PCT Filed: Apr. 30, 2018

(86) PCT No.: PCT/US2018/030147

§ 371 (c)(1),
(2) Date: Oct. 7, 2019

(87) PCT Pub. No.: WO2019/212471

PCT Pub. Date: Nov. 7, 2019

(65) Prior Publication Data

US 2021/0379911 A1 Dec. 9, 2021

(51) Int. Cl.
*B41J 11/68* (2006.01)
*B26D 5/02* (2006.01)
(Continued)

(52) U.S. Cl.
CPC ..... *B41J 11/68* (2013.01); *B26D 5/02* (2013.01); *B41J 11/70* (2013.01); *B41J 11/706* (2013.01);
(Continued)

(58) Field of Classification Search
CPC . B41J 11/68; B41J 11/706; B41J 11/70; B41J 11/703; B41J 11/663; B41J 11/66;
(Continued)

(56) References Cited

U.S. PATENT DOCUMENTS 4,667,554 A 5/1987 Peery
5,328,437 A 7/1994 Maylander et al.
(Continued)

FOREIGN PATENT DOCUMENTS

CN 1229379 A 9/1999
CN 1370663 A 9/2002
(Continued)

*Primary Examiner* — Henok D Legesse

(57) ABSTRACT

Disclosed is a cutter module to be used with a printing apparatus. The cutter module comprises a blade driving mechanism; and a rotary cutting blade driven by the blade driving mechanism. The blade driving mechanism comprises: a clutch mechanism selectively to enable the blade driving mechanism to drive the rotary cutting blade in a forward cutting direction or a backward direction. Also disclosed is a printing system comprising the cutter module and a method to be used with the cutter module.

15 Claims, 7 Drawing Sheets

(51) Int. Cl.

| | |
|---|---|
| ***B41J 11/70*** | (2006.01) |
| *B26D 5/08* | (2006.01) |
| *B26D 7/26* | (2006.01) |
| *B41J 11/66* | (2006.01) |

(52) U.S. Cl.
CPC ..... *B26D 5/08* (2013.01); *B26D 7/2621* (2013.01); *B26D 7/2635* (2013.01); *B41J 11/66* (2013.01); *B41J 11/663* (2013.01); *B41J 11/703* (2013.01)

(58) Field of Classification Search
CPC ..... B26D 5/02; B26D 5/08; B26D 7/2621; B26D 7/2635
See application file for complete search history.

(56) References Cited

U.S. PATENT DOCUMENTS

| | | | |
|---|---|---|---|
| 5,482,389 | A | 1/1996 | Bickoff et al. |
| 5,911,530 | A | 6/1999 | Hinojosa et al. |
| 5,971,640 | A | 10/1999 | Brewington et al. |
| 6,182,550 | B1 | 2/2001 | Brewington et al. |
| 6,286,403 | B1 | 9/2001 | Rosenthal |
| 6,408,727 | B1 | 6/2002 | Harris et al. |
| 9,731,524 | B2 | 8/2017 | Nishijima et al. |
| 2002/0118990 | A1 | 8/2002 | Kwasny et al. |
| 2012/0297945 | A1 | 11/2012 | Cordero et al. |
| 2016/0185139 | A1 | 6/2016 | Ishida et al. |
| 2016/0185140 | A1 | 6/2016 | Ishida |
| 2016/0288541 | A1 | 10/2016 | Kano et al. |

FOREIGN PATENT DOCUMENTS

| | | | | |
|---|---|---|---|---|
| CN | 102673185 | A | 9/2012 | |
| CN | 105730031 | A | 7/2016 | |
| CN | 105751672 | A | 7/2016 | |
| CN | 107931731 | A | 4/2018 | |
| CN | 108602640 | A | 9/2018 | |
| EP | 3124188 | A1 | 2/2017 | |
| GB | 354924 | A | 6/1974 | |
| JP | 3143868 | U | 8/2008 | |
| WO | WO2011146272 | A1 | 11/2011 | |
| WO | WO-2016066223 | A1 * | 5/2016 | ..... B26D 1/085 |
| WO | WO-2017176274 | A1 | 10/2017 | |
| WO | WO-2017188937 | A1 | 11/2017 | |

* cited by examiner

FORWARD AND BACKWARD ROTATION OF PRINTER CUTTERS

BACKGROUND

In some printing systems, apparatus to cut printing media may be provided. The apparatus to cut printing media may include a cutting blade which cuts printing media.

BRIEF DESCRIPTION OF THE DRAWINGS

Various features of the present disclosure will be apparent from the detailed description which follows, taken in conjunction with the accompanying drawings, which together illustrate features of the present disclosure, and wherein.

DETAILED DESCRIPTION

In the following description, for purposes of explanation, numerous specific details of certain examples are set forth. Reference in the specification to "an example" or similar language means that a particular feature, structure, or characteristic described in connection with the example is included in that one example, but not necessarily in other examples.

Figure 1:
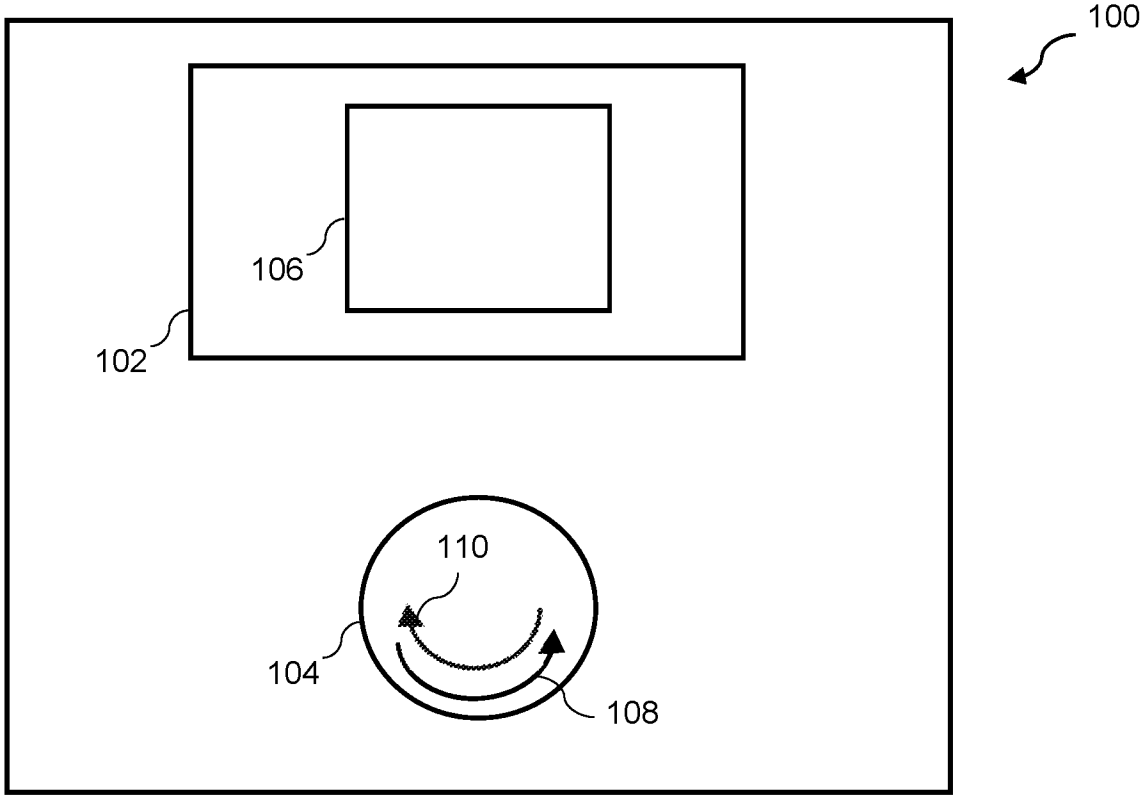
FIG. 1 is a schematic view of a cutter module.

FIG. 1 schematically illustrates a cutter module 100 (which may also be referred to as a "cutting unit") to be used with a printing apparatus. The cutter module 100 may comprise a blade driving mechanism 102 (also referred to as a "cutter actuating mechanism") and a rotary cutter, in the form of a rotary cutting blade 104 driven by the blade driving mechanism 102. The blade driving mechanism 102 may comprise a clutch mechanism 106 selectively to enable the blade driving mechanism 102 to drive the rotary cutting blade 104 in a forward cutting direction 108 or a backward direction 110.

Figure 2:
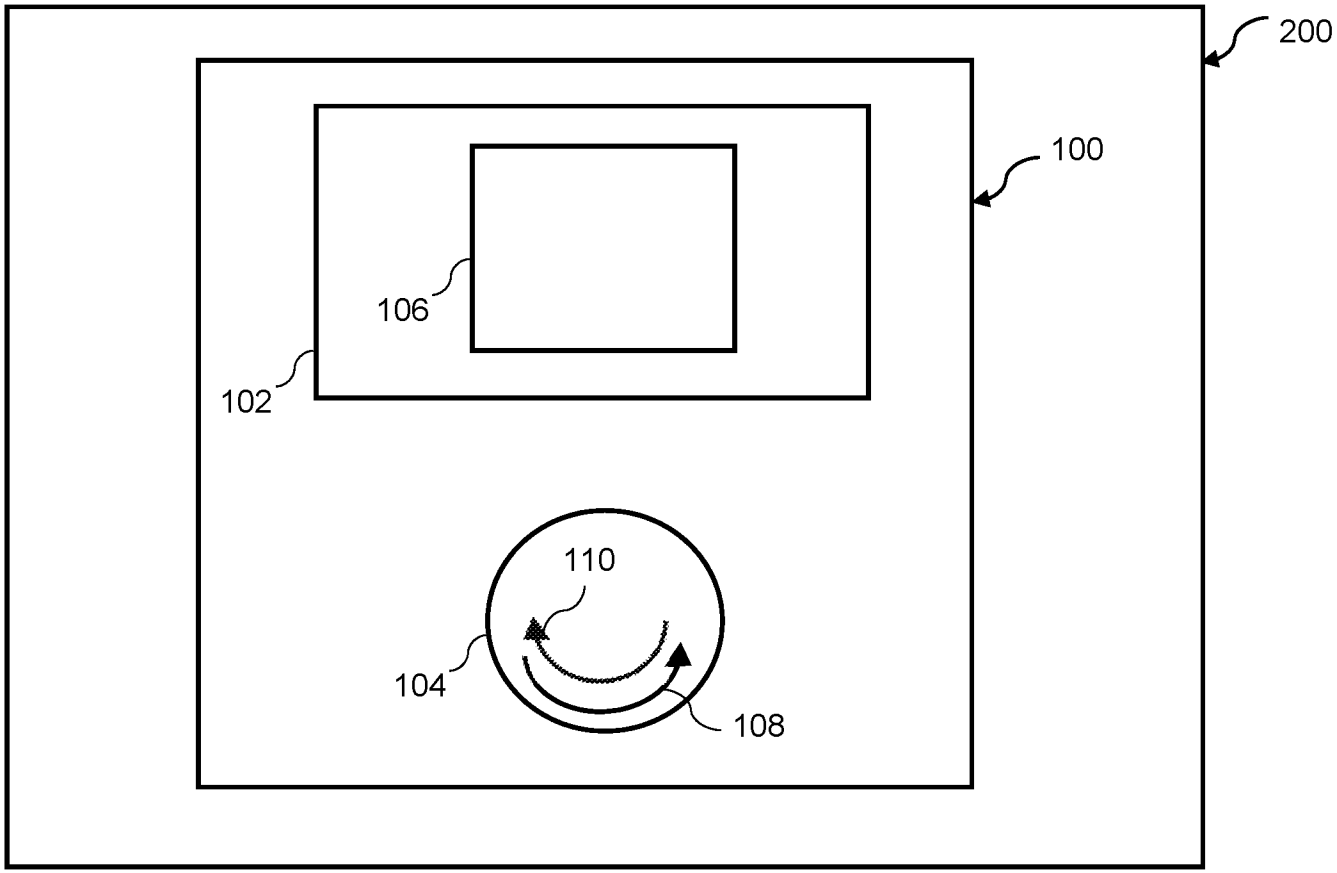
FIG. 2 is a schematic view of a printing system comprising the cutter module of FIG. 1.

FIG. 2 schematically illustrates a printing system 200. In this example, the printing system 200 comprises the cutter module 100 described above.

The cutter module 100 may be a module/unit of the printing system 200, and be used to cut printing media on which the printing system 200 prints. The printing media may, for example, include paper, card, sheets comprising plastic, textiles, or any other printing media onto which material may be deposited to produce printed content. The cutter module 100 may be removable from the printing system 200. In some examples, the cutter module 100 may be provided separately to the printing system 200. The printing system 200 may include more than one cutter module 100. For example, two or more cutter modules 100 may be provided to cut excess printing media either side of the part of printed content produced on the printing media.

Figure 3A:
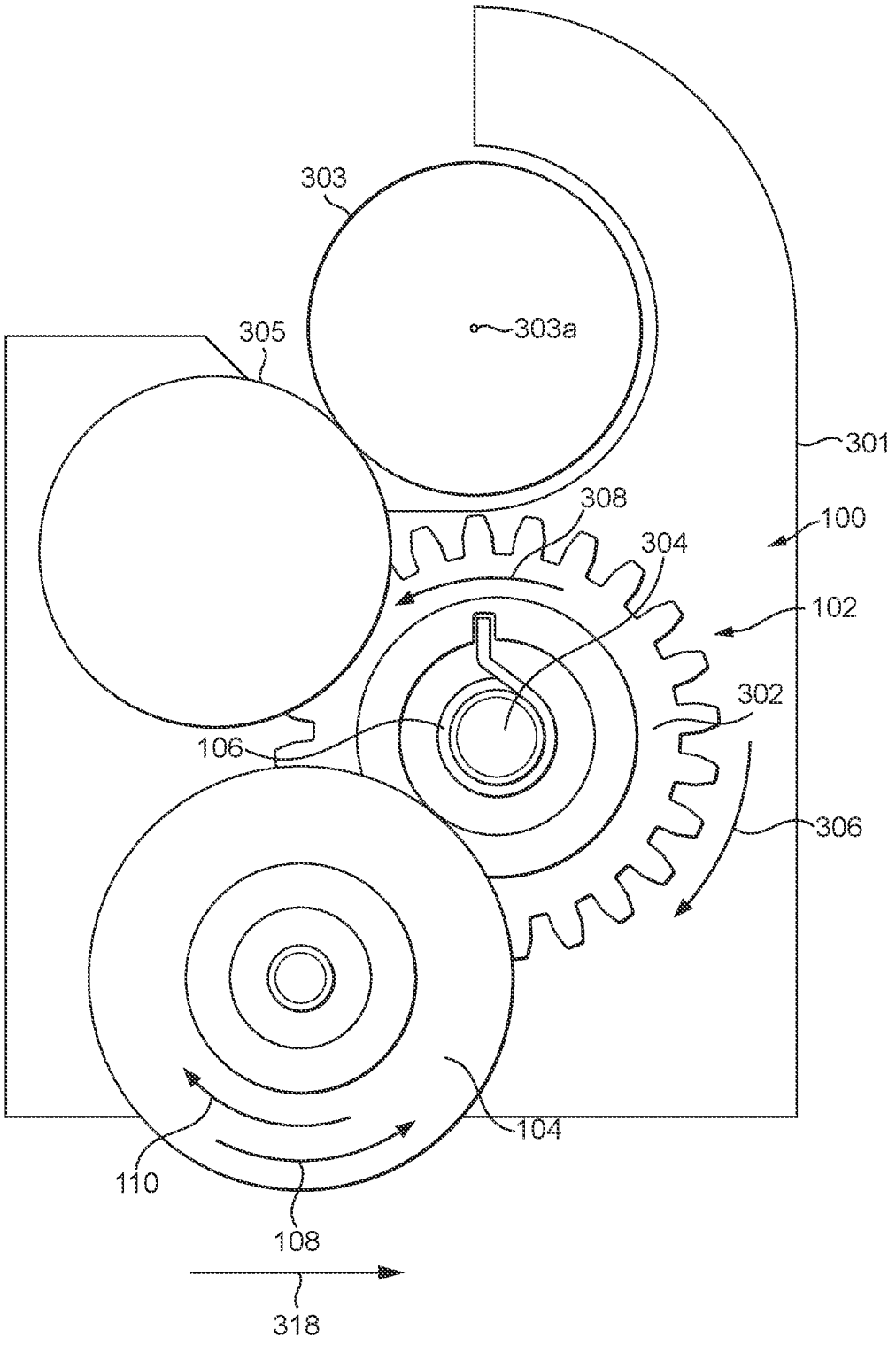
FIG. 3*a* is a first schematic view of a first example of the cutter module of FIG. 1.

FIG. 3*a* schematically illustrates a first example of the cutter module 100. The cutter module 100 includes a main body 301 onto which the blade driving mechanism 102 and the cutter 104 are mounted. In this example, the blade driving mechanism 102 includes a gear 302 (hereinafter "driving gear 302") operatively connected to the clutch 106 and the rotary cutting blade 104 (hereinafter "cutter 104"). In some examples, the cutter module 100 may also include a second, opposing cutter (not shown), and the printing media may pass between the cutters as it is being cut. The second cutter may be passive in that it may not be driven by the blade driving mechanism 102.

Figure 3B:
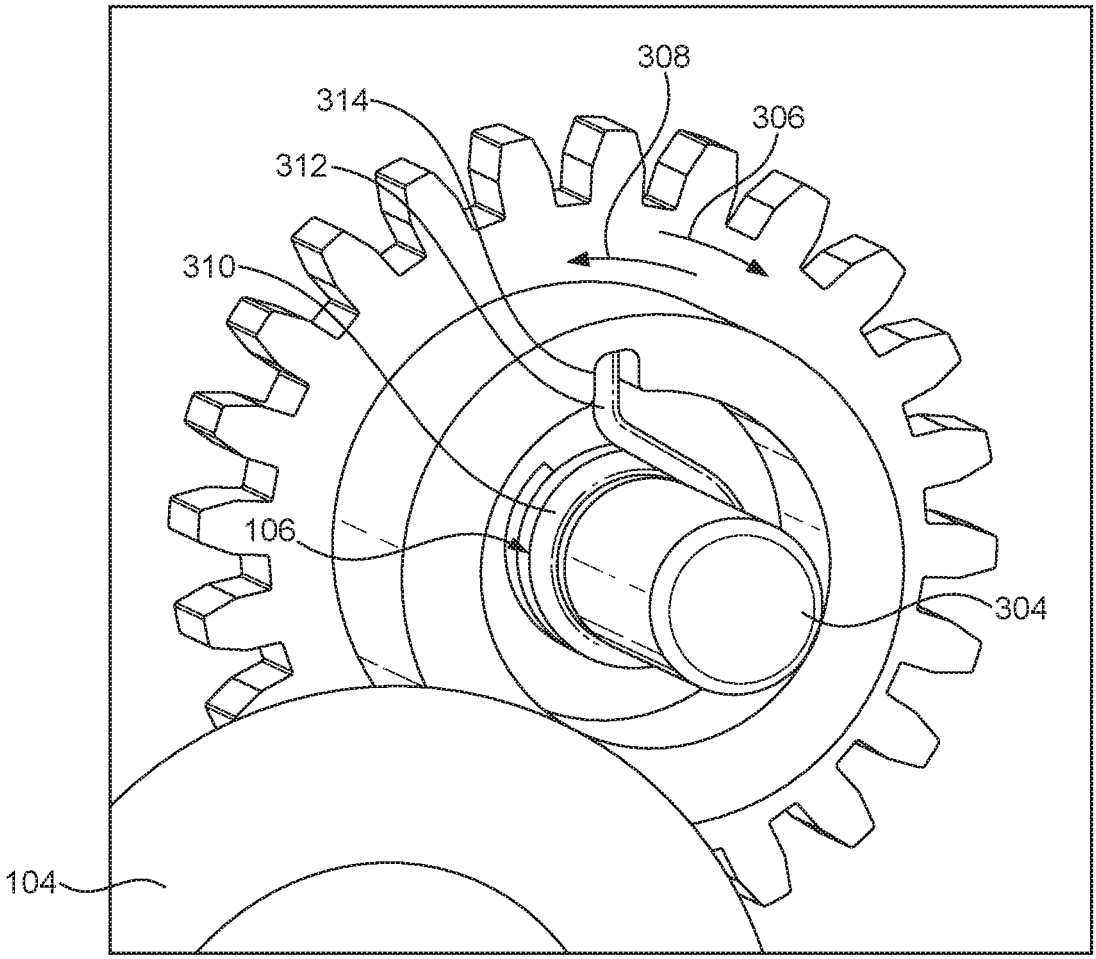
FIG. 3*b* is a second schematic view of the first example of the cutter module of FIG. 1.

In this example, the driving gear 302 is mounted on a gear shaft 304 which is a shaft with a circular cross section extending from the main body 301. The clutch 106 engages with the driving gear 302 and includes a clutch base 310 mounted onto the gear shaft 304. The clutch 106 engages with the driving gear 302 so that the driving gear 302 and the clutch 106 are connected. The clutch 106 enables the rotation of the driving gear 302 by rotating about the gear shaft 304 together with the driving gear 302. FIG. 3*b* illustrates a zoomed in view of the driving gear 302 and the clutch 106, and shows a first clutch structure 312 to engage with a first engagement structure 314 of the driving gear 302.

Figure 3C:
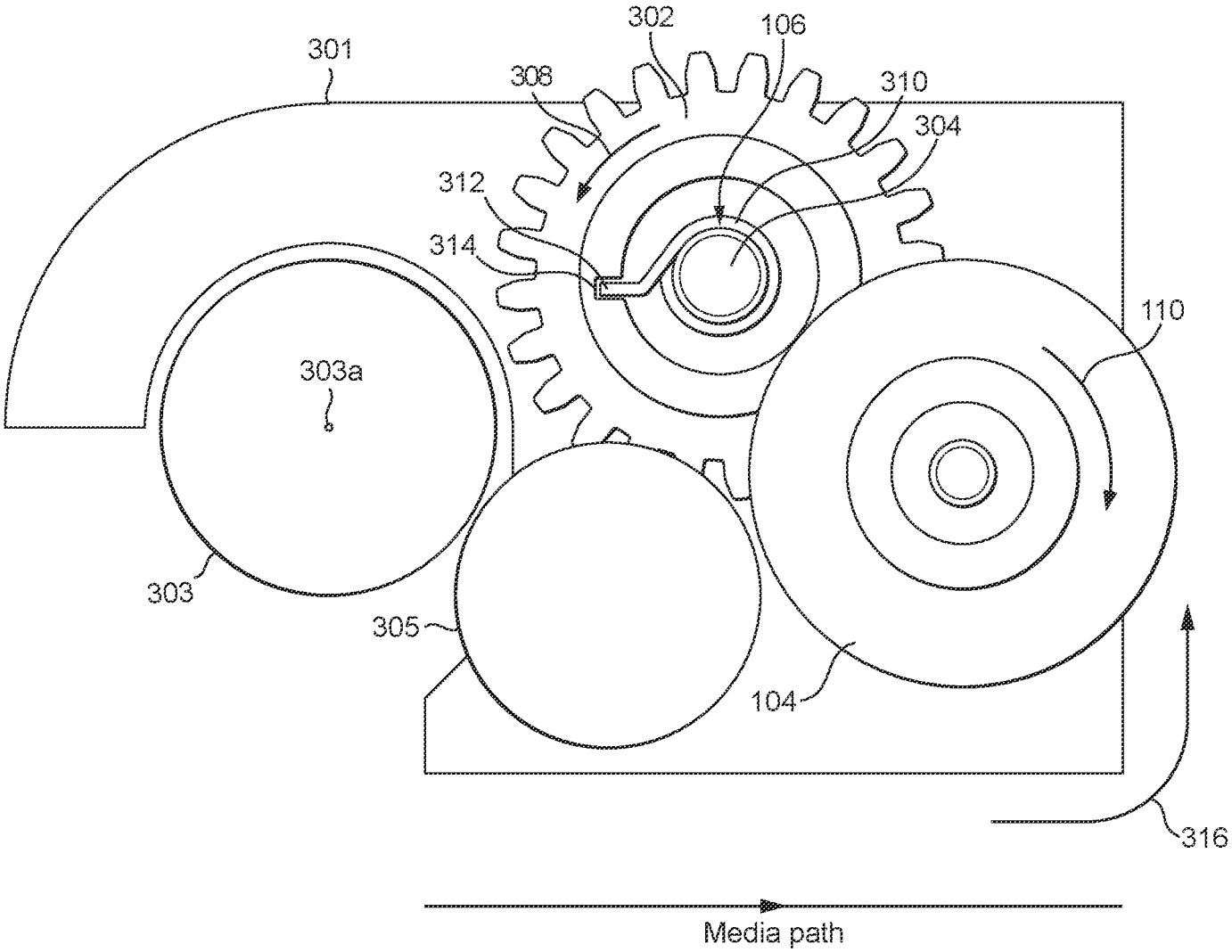
FIG. 3*c* is a third schematic view of the first example of the cutter module of FIG. 1.

The driving gear 302 is driven to rotate by a driving mechanism of the printing system 200. In the example of FIGS. 3*a-c*, the driving mechanism of the printing system 200 comprises a driving rod 303 operatively connected to the driving gear 302 so that rotation of the driving rod 303 causes rotation of the driving gear 302. The driving rod 303 may have a circular cross section as illustrated in the figures or a non-circular cross section (e.g. a hexagonal cross section). The rotation of the driving rod 303 may be transferred to the driving gear 302 via a transfer wheel 305 which is in contact with the driving rod 303. For example, the transfer wheel 305 may include a gear mesh (not shown) which meshes with corresponding meshes (not shown) on the driving gear 302 to transfer rotational movement from the driving rod 303 to the driving gear 302.

As described above, the driving gear 302 is operatively connected to the cutter 104 as well as the clutch 106, such that when the driving gear 302 rotates, the cutter 104 is urged to rotate. For example, the rotational movement of the driving gear 302 in a first direction 306 may cause the rotational movement of the cutter 104 in the forward cutting direction 108, and the rotational movement of the driving gear 302 in a second direction 308 may cause the rotational movement of the cutter 104 in the backward direction 110. For example, a cutter gear (not shown) may mesh with the driving gear 302 illustrated so that rotational movement of the driving gear 302 causes the cutter 104 to rotate. Since the clutch 106 enables the rotation of the driving gear 302, the rotational movement of the cutter 104 is enabled by the rotational movement of the clutch base 310 about the gear shaft 304.

When the cutter module 100 is being used to cut printing media, the blade driving mechanism 102 may drive the cutter 104 to rotate in the forward cutting direction 108. For example, the driving mechanism of the printing system 200 may drive the driving gear 302 in the first direction 306 so that the cutter 104 rotates in the forward cutting direction 108. When rotating in the forward cutting direction 108, the cutter 104 may cut printing media advancing in a forward advance direction as shown by arrow 318 in FIG. 3*a*.

When the driving mechanism 102 drives the cutter 104 in the backward direction 110, the cutter module 100 may be urged to rotate towards a parking position (also referred to as a "resting position") and away from a cutting position (also referred to as an "active position") in a direction shown by arrow 316 in FIG. 3*c*. The rotation of the cutter module 100 towards the parking position occurs about the axis 303*a* of the driving rod 303. The position of the axis 303*a* is fixed with respect to the media path along which the printing media advances. In the cutting position, the cutter 104 is in contact with the printing media on the media path. When the cutter module 100 rotates about the axis 303*a* towards the parking position, the cutter 104 moves away from the media path. An example method by which the rotation of the cutter module 100 towards the parking position is enabled is described below.

Referring again to FIG. 3*b*, the clutch base 310 may comprise a coil spring including coiled loops of a spring wire. The first clutch structure 312 may comprise a protrusion, in the form of an arm 312, extending away from an end of the clutch base 310, formed by an end part of the spring wire. An end of the spring wire opposite to the arm 312 may, for example, be fixed to the gear shaft 304. The clutch 106 may engage with the driving gear 302 by way of the arm 312 engaging with the engagement structure 314, so that the clutch 106 and the driving gear 302 are connected.

The engagement structure 314 may be a depression or a notch in a surface of the driving gear 302 within which an end part of the arm 312 may be retained. In the example of FIGS. 3*a-c*, the engagement structure 314 is a depression/notch in a surface of the driving gear 302 facing the gear shaft 304, and an end of the arm 312 is located in the engagement structure 314, so as to engage with same. In some examples, the engagement structure 314 may be formed of a pair of protrusions from a surface of the driving gear 302, which protrusions retain the arm 312 between them when the driving gear 302 rotates about the gear shaft 304.

In examples, the arm 312 may be retained within the engagement structure 314 when the driving gear 302 rotates. Contact between the clutch base 310 and the gear shaft 304 causes a friction torque directed against the direction of rotation of the clutch 106 about the gear shaft 304. When there is sufficient torque applied to the driving gear 302 to overcome this friction torque, rotation of the gear causes the clutch 106 to rotate about the gear shaft 304 in correspondence with the rotation of the driving gear 302.

In examples, the friction torque between the clutch base 310 and the gear shaft 304 is such that clutch 106 enables the gear to rotate in both directions when the driving gear 302 is driven by the driving rod 303. Therefore, in examples, the cutter 104 may selectively be driven to rotate in the backward direction 110 as well as the forward cutting direction 108.

In examples, the friction torque between the clutch base 310 and the gear shaft 304 against the rotational movement of the driving gear 302 about the gear shaft 304 in the second direction 308 may be such that, when the driving gear 302 is driven in the second direction 308 by the driving mechanism of the printing system 200, the cutter module 100 is urged to rotate towards the parking position and away from the cutting position, and the driving gear 302 rotates in the second direction 308.

The friction torque between the clutch base 310 and the gear shaft 304 against the rotational movement of the driving gear 302 about the gear shaft 304 in the second direction 308 may be greater than the friction torque between the clutch base 310 and the gear shaft 304 against the rotational movement of the driving gear 302 about the gear shaft 304 in the first direction 306. This difference in the friction torque in the two opposing directions may allow easy rotation of the cutter 104 in the forward cutting direction 108, but provide a greater resistance in the opposite direction which is sufficient to cause rotation of the cutter module 100 about axis 303*a* to the parking position whilst at the same time enabling rotation of the cutter 104 in the backward direction 110 thereby preventing that the substrate gets trapped within the cutter.

For example, the friction torque against rotation of the driving gear 302 in the second direction 308 may be high enough such that not all of the rotational motion that the driving mechanism of the printing system 200 provides is translated into the rotational movement of the driving gear 302 in the second direction 308. This causes some of the rotational motion to be translated into the rotation of the cutter module 100 towards the parking position.

The arm 312 may be pushed by the engagement structure 314 in the first direction 306 when the driving gear 302 is driven in the first direction 306. When this happens, the arm 312 initially moves an amount relative to the clutch base 310 while the clutch base 310 is stationary. This movement causes the clutch base 310 to loosen around the gear shaft 304, due to the orientation of the coil spring on the gear shaft 304 as shown in FIG. 3*b*. Pushing the arm 312 in the first direction 306 pulls opposite ends of the spring wire (the arm 312 and the opposite end fixed to the gear shaft 304) in opposing directions, resulting in a partial unwrapping (loosening) of the spring coil. This reduces the friction torque between the clutch base 310 and the gear shaft 304, allowing the clutch base 310 to slip against the gear shaft 304 with less of a gripping force between the clutch base 310 and the gear shaft 304. The clutch base 310 rotates around the gear shaft 304 with the spring base in this loosened configuration, driving rotation of the cutting blade 104 in the forward direction.

On the other hand, the arm 312 is pushed in the second direction 308 when the driving gear 302 rotates in the second direction 308. The arm 312 initially moves relative to the clutch base 310 in the second direction 110. This causes the clutch base 310 to tighten around the gear shaft 304 thereby exerting a gripping force on the shaft 304, due to the orientation of the coil spring on the gear shaft 304 as shown in FIG. 3*b*. Pushing the arm 312 in the second direction pushes opposite ends of the spring wire (the arm 312 and the opposite end fixed to the gear shaft 304), resulting in a tightening of the spring coil. This increases the friction torque between the clutch base 310 and the gear shaft 304. The clutch base 310 rotates around the gear shaft 304 with the spring base in this tightened configuration, driving rotation of the cutting blade 104 in the backward direction.

The friction torque in the second direction 308 (with the clutch base 310 in the tightened configuration) is thus greater than the friction torque in the first direction 306 (with the clutch base in the loosened configuration). The greater friction torque in the second direction causes some of the rotational movement of the drive rod 303 to be transferred to rotational movement of the cutter module 100 about the axis 303*a* towards the parking position. Part of the torque applied to the outer parts of the driving gear 302 in the second direction 110 does not translate into rotation of the driving gear 302. This causes rotation of the cutter module 100 about the axis 303*a* in the direction shown by arrow 316 towards the parking position.

Figure 4:
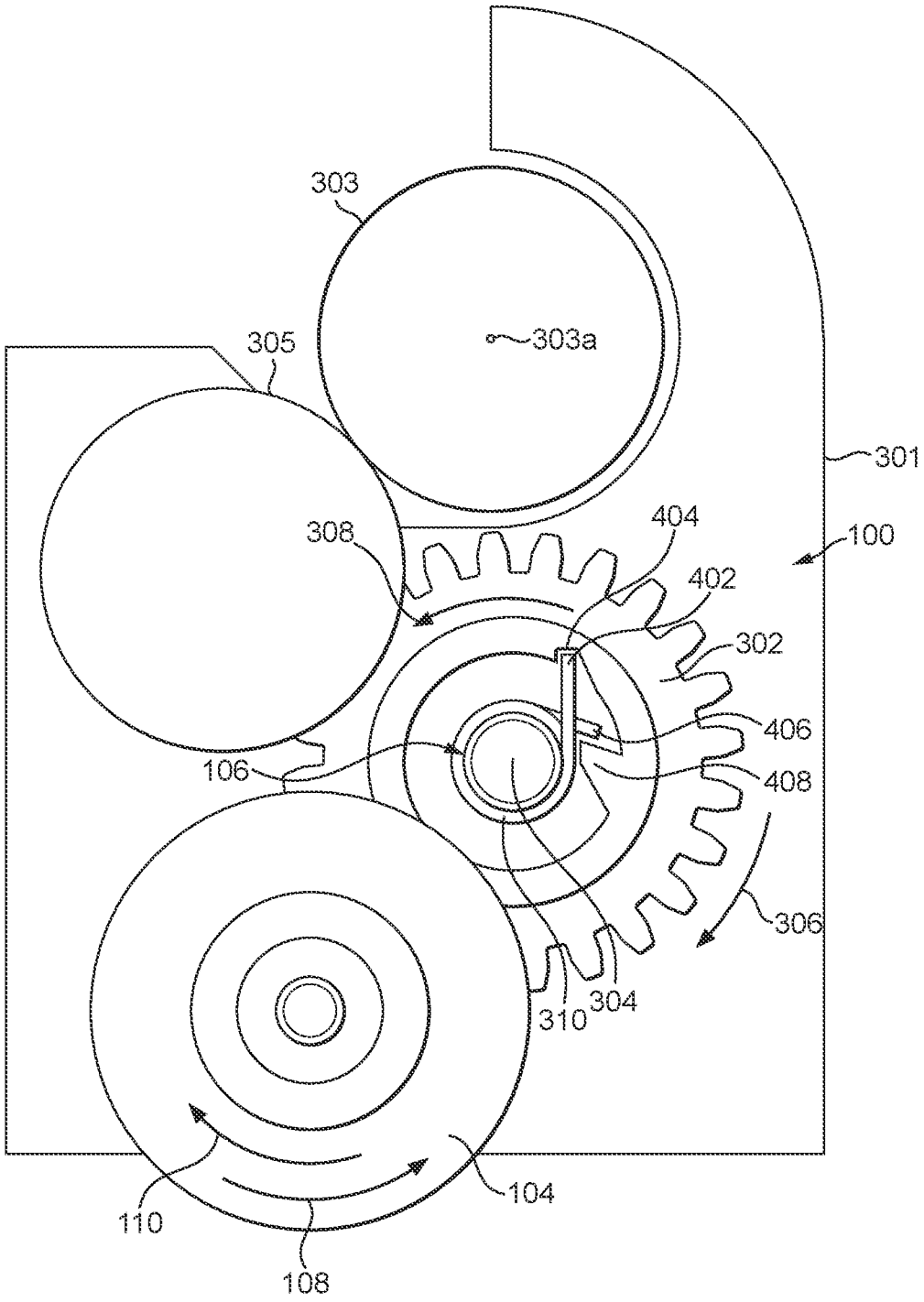
FIG. 4 is a schematic view of a second example of the cutter module of FIG. 1.

The first example cutter module 100 described above includes an arm 312 to engage with an engagement structure 408. FIG. 4 schematically illustrates a second example of the cutter module 100, in which, the clutch 106 comprises a first clutch structure 402 to engage with a second engagement structure 404 of the driving gear 302, and a second clutch structure 406 to engage with a second engagement structure 408 of the driving gear 302.

In this example, the first and second clutch structures 402, 406 are protrusions in the form of a first arm 402 and a second arm 406. The first engagement structure 404 may be a structure, such as a protrusion, on a surface of the driving gear 302 which engages with the first arm 402 when the driving gear 302 rotates in the first direction 306. The second engagement structure 408 may be a structure, such as a protrusion, on a surface of the driving gear 302 which catches the second arm 406 when the driving gear 302 rotates in the second direction 308. In this example, rotation of the driving gear in both the first direction and the second direction results in a loosening of the clutch base 310

The first arm 402 may have a greater length than the second arm 406. This means that when the first arm 402 is pushed in the first direction 306 by the first engagement structure 404, the moment applied to urge the clutch base 310 to rotate in the first direction 306 is greater than the moment applied to urge the clutch base 310 to rotate in the second direction 308 when the second arm 406 is pushed in the second direction 308 by the second engagement structure 408 (for the same magnitude of drive applied to the driving gear 302).

Due to this difference in the respective moments applied to the first and second arms 402, 406 (and therefore the moment applied to them for the same drive magnitude in the opposite directions), the clutch base 310 loosens more when the first arm 402 is pushed in the first direction 306 than when the second arm 406 is pushed in the second direction 308. The causes a greater friction torque against rotation in the second direction 308 than in the first direction 306. As a result, the cutter 104 may turn easily in the forward cutting direction, whereas rotation in the backward direction 110 is accompanied by sufficient frictional torque to drive the rotation of the cutter module 100 towards the parking position in the same manner as described above.

According to the above examples, movement of the driving 302 in the second direction 308 drives the cutter blade 104 in the backwards direction, simultaneous with movement of the cutter module 100 towards the parking position. During the printing process, the printing media may move backwards, i.e. in a direction opposite to the forward advance direction 318. In systems in which driving the rotation of a cutter blade is enabled in the forward direction and not in the backward direction, with driving in the backward direction resulting in movement of a cutting module towards the parking position and not in rotation of the cutter, the backwards movement can cause damage to the printing media or a blockage in components of the cutter module or the printing system, for example. Because the cutter module 100 according to examples described herein enables the cutter 104 to rotate in the backward direction 110, such damage or blockage may be prevented or ameliorated.

Figure 5:
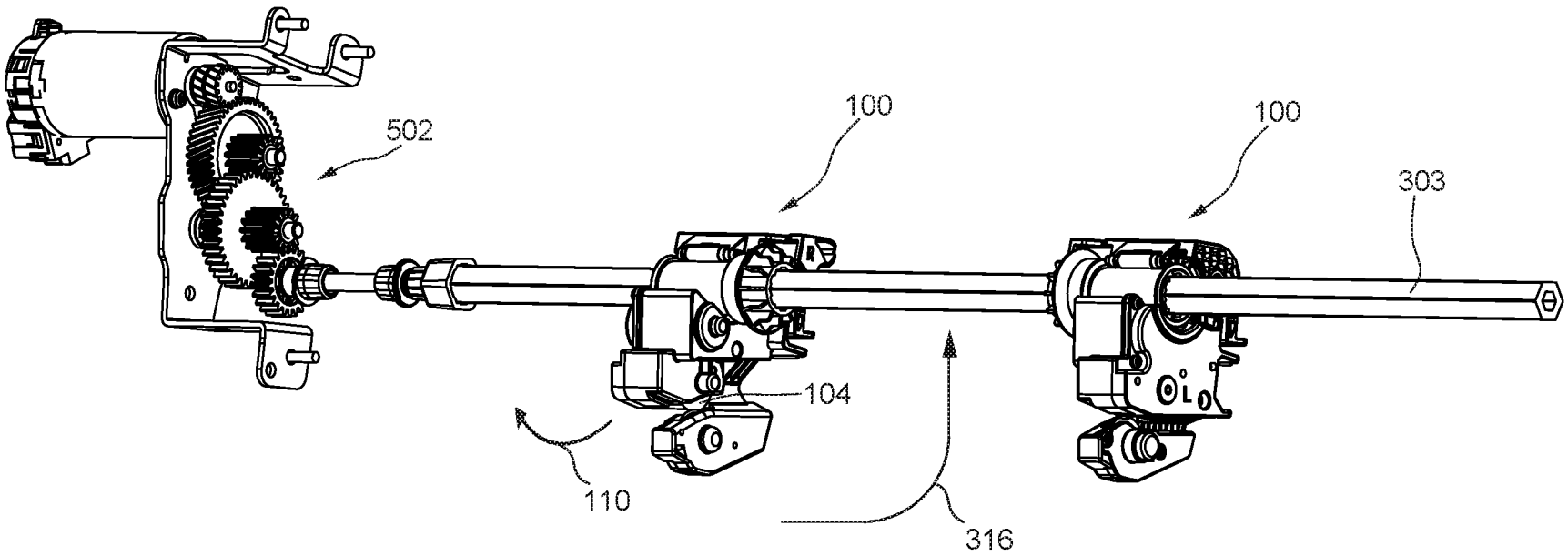
FIG. 5 is a schematic view of components of a printing apparatus.

FIG. 5 illustrates components of the printing system 200. FIG. 5 shows the drive mechanism 502 of the printing system 200 which comprises the drive rod 303. In this example, there are two cutter modules 100 connected to the drive mechanism 502. The cutter modules 100 shown may be according to any example described above. As described above, the rotation of the drive bar 303 drives the gears 302 of the cutter modules 100 to rotate in order to drive cutter blades 104.

A method to be used with the cutter modules 100 may be performed using the components shown in FIG. 5. The driving mechanism 502 may cause the cutter modules 100 to move from the cutting position (as shown in FIG. 5) to a parking position (not shown), and the cutters 104 of the cutter modules 100 to rotate in the backward direction 110 (opposite to the forward cutting direction 108) during the movement towards the parking position.

For example, the drive rod 303 is driven to rotate such that the cutter modules 100 rotate in the direction shown by arrow 316 towards the parking position. At the same time the drive gears 302 in the cutter modules 100 rotate in the second direction 308 (being driven by the rotation of the drive rod 303) and cause the respective cutters 104 to rotate in the backward direction 110. Such a method may, for example, be performed on any number of cutter modules connected to the drive mechanism 502.

The preceding description has been presented to illustrate and describe examples of the principles described. This description is not intended to be exhaustive or to limit these principles to any precise form disclosed. Many modifications and variations are possible in light of the above teaching. It is to be understood that any feature described in relation to any one example may be used alone, or in combination with other features described, and may also be used in combination with any features of any other of the examples, or any combination of any other of the examples.

What is claimed is:

1. A cutter module to be used with a printing apparatus, the cutter module comprising:
- a blade driving mechanism; and
- a rotary cutting blade driven by the blade driving mechanism,
- wherein the blade driving mechanism comprises:
  - a clutch mechanism selectively to engage the blade driving mechanism to drive the rotary cutting blade in a forward cutting direction in a first mode of operation and in a backward direction in a second mode of operation.

2. A cutter module according to claim 1, wherein, when the clutch mechanism enables the blade driving mechanism to drive the rotary cutting blade in the backward direction, the cutter module is urged to rotate towards a parking position and away from a cutting position.

3. The cutter module according to claim 1, wherein:
- the blade driving mechanism comprises a gear operatively connected to the clutch mechanism and the rotary cutting blade;
- the gear is mounted on a gear shaft; and
- the clutch mechanism engages with the gear and comprises a clutch base to be mounted onto the gear shaft.

4. The cutter module according to claim 3, wherein the rotational movement of the rotary cutting blade is enabled by rotational movement of the clutch base about the gear shaft.

5. The cutter module according to claim 3, wherein rotational movement of the gear in a first direction causes the rotational movement of the rotary cutting blade in the forward cutting direction, and rotational movement of the gear in a second direction causes the rotational movement of the rotary cutting blade in the backward direction.

6. The cutter module according to claim 5, wherein
- a friction torque between the clutch base and the gear shaft against the rotational movement of the gear about the gear shaft in the second direction is such that, when the gear is driven in the second direction by a driving mechanism of the printing apparatus:
  - the cutter module is urged to rotate towards a parking position and away from a cutting position; and
  - the gear rotates in the second direction.

7. The cutter module according to claim 6, wherein the friction torque between the clutch base and the gear shaft against the rotational movement of the gear about the gear shaft in the second direction is greater than a friction torque between the clutch base and the gear shaft against the rotational movement of the gear about the gear shaft in the first direction.

8. The cutter module according to claim 7, wherein:

the clutch base loosens around the gear shaft when the gear is driven in the first direction by the driving mechanism of the printing apparatus; and the clutch base tightens around the gear shaft when the gear is driven in the second direction by the driving mechanism of the printing apparatus.

9. The cutter module according to claim 8, wherein the clutch base comprises a coil spring.

10. The cutter module according to claim 3, wherein the clutch mechanism comprises a first clutch structure to engage with a first engagement structure of the gear.

11. The cutter module according to claim 10, wherein the clutch mechanism comprises a second clutch structure to engage with a second engagement structure of the gear.

12. The cutter module according to claim 11, wherein:

a friction torque between the clutch base and the gear shaft against the rotational movement of the gear about the gear shaft is greater when the second clutch structure engages with the second engagement structure than a friction torque between the clutch base and the gear shaft against the rotational movement of the gear about the gear shaft when the first clutch structure engages with the first engagement structure; and the second clutch structure has a greater length than the second clutch structure.

13. A printing system comprising:

a cutting unit to cut printing media, the cutting unit comprising a rotary cutter and a cutter actuating mechanism to cause the rotary cutter to rotate, wherein:

the cutter actuating mechanism comprises a clutch selectively to engage the cutter actuating mechanism to cause the rotary cutter to rotate in a forward direction in a first mode of operation and in a backward direction in a second mode of operation.

14. The printing system according to claim 13, wherein, when the clutch enables the cutter actuating mechanism to cause the rotary cutter to rotate in the backward direction, the cutting unit is caused to rotate towards a resting position and away from an active position.

15. A method to be used with a cutter module of a printing apparatus, comprising:

a driving mechanism of the printing apparatus:

causing the cutter module to move from a cutting position to a parking position, and causing a rotary cutting blade of the cutter module to rotate in a backward direction during the movement to the parking position, and causing the cutter module to move to the cutting position, and causing the rotary cutting blade of the cutter module to rotate in a forward direction during the movement to the cutting position, the backward direction being opposite to the forward cutting direction.

* * * * *